US008169284B2

(12) United States Patent
Talon

(10) Patent No.: US 8,169,284 B2
(45) **Date of Patent: *May 1, 2012**

(54) ELECTROMAGNETIC ACTUATOR HAVING PERMANENT MAGNETS PLACED IN THE FORM OF A V IN AN ELECTROMAGNETICALLY OPTIMIZED ARRANGEMENT

(75) Inventor: Emmanuel Talon, Verneuil sur Seine (FR)

(73) Assignee: Valco Systemes de Controle Moteur, Cergy Pontoise Cedex (FR)

( * ) Notice: Subject to any disclaimer, the term of this patent is extended or adjusted under 35 U.S.C. 154(b) by 607 days.

This patent is subject to a terminal disclaimer.

(21) Appl. No.: 12/094,216

(22) PCT Filed: Jan. 8, 2007

(86) PCT No.: PCT/FR2007/000019

§ 371 (c)(1), (2), (4) Date: May 19, 2008

(87) PCT Pub. No.: WO2007/080301

PCT Pub. Date: Jul. 19, 2007

(65) Prior Publication Data

US 2010/0271157 A1 Oct. 28, 2010

(30) Foreign Application Priority Data

Jan. 12, 2006 (FR) ..... 06 00261

(51) Int. Cl.
*H01F 7/00* (2006.01)
*H01F 7/08* (2006.01)

(52) U.S. Cl. ..... 335/229; 335/126; 335/179; 335/220; 335/296; 335/297; 335/302

(58) Field of Classification Search ..... 335/126, 335/179, 205, 219, 220, 222, 229, 296, 297, 335/302; 310/154, 154.01, 154.21, 154.32, 310/154.43, 181; 123/90.11; 251/65, 129.16
See application file for complete search history.

(56) References Cited

U.S. PATENT DOCUMENTS 3,772,540 A * 11/1973 Benson ..... 310/14
3,906,268 A * 9/1975 de Graffenried ..... 310/154.46
4,187,452 A * 2/1980 Knappe et al. ..... 318/128

(Continued)

OTHER PUBLICATIONS

International Search Report with English Translation from PCT/FR2007/000019 mailed Jun. 13, 2007 (4 pages).

*Primary Examiner* — Mohamad Musleh
(74) *Attorney, Agent, or Firm* — Osha • Liang LLP

(57) ABSTRACT

The invention relates to an electromagnetic actuator including an actuating member associated with an armature and able to move under the action of at least one electromagnet, a coil, and a core suitable for channeling a flux of the coil so that the flux closes within the armature, where the core includes a base from which branches extend, including a central branch around which the coil extends, and two permanent magnets which are associated with the core. The two permanent magnets are placed in the central branch of the core in order to form a V, which separates the central branch into two parts so that any section of the core or the armature through which the flux from one or the other of the permanent magnets can pass, has an area large enough to prevent saturation by this flux.

10 Claims, 2 Drawing Sheets

U.S. PATENT DOCUMENTS 4,945,330 A * 7/1990 Arita ..... 335/229
4,988,907 A * 1/1991 Irwin ..... 310/181
7,124,720 B2 * 10/2006 Liang et al. ..... 123/90.11
7,156,057 B2 * 1/2007 Lecrivain et al. ..... 123/90.11
7,249,579 B2 * 7/2007 Liang et al. ..... 123/90.11
7,426,911 B2 * 9/2008 Liang et al. ..... 123/90.11
2005/0211199 A1 * 9/2005 Liang et al. ..... 123/90.11
2005/0211200 A1 9/2005 Liang et al.
2005/0279300 A1 12/2005 Liang et al.
2007/0131185 A1 * 6/2007 Liang et al. ..... 123/90.11
2008/0276889 A1 * 11/2008 Sfaxi et al. ..... 123/90.11
2008/0283784 A1 * 11/2008 Sfaxi et al. ..... 251/65

* cited by examiner

ELECTROMAGNETIC ACTUATOR HAVING PERMANENT MAGNETS PLACED IN THE FORM OF A V IN AN ELECTROMAGNETICALLY OPTIMIZED ARRANGEMENT

The invention relates to an electromagnetic actuator having permanent magnets arranged in the form of a V in an electromagnetically optimized arrangement.

BACKGROUND OF THE INVENTION

Document FR 2 865 238 discloses an electromagnetic actuator having an actuating member associated with an armature that can move under the action of an electromagnet, comprising a coil and a core suitable for channeling the flux of the coil so as to form a return path in the armature, the core having a base from which branches extend, including a central branch around which the coil extends. The electromagnet comprises two permanent magnets which are incorporated into the core in such a way that the latter channels the flux of the permanent magnets so as to form a return path in the armature, the flux of the coil passing through the magnets. In one of the embodiments illustrated in that document, the permanent magnets are placed obliquely in the lateral branches of the core, thereby making it possible to house, in the core, magnets having a length substantially equal to the height of the coil without correspondingly increasing the height of the electromagnet.

However, such an arrangement means that the laminations of the core have to be cut so as to allow the magnets to be inserted, thereby mechanically weakening the laminations and posing assembly problems. Furthermore, it is necessary to leave connecting portions behind on the laminations in order to keep the cut parts of the laminations together, the linking portions thus forming as many short circuits, which are saturated by the flux of the neighboring magnet.

SUBJECT OF THE INVENTION

The subject of the invention is an electromagnetic actuator having oblique magnets that has a higher electromagnetic efficiency.

BRIEF DESCRIPTION OF THE INVENTION

To achieve this objective, the invention provides an electromagnetic actuator, having an actuating member associated with an armature and capable of moving under the action of at least one electromagnet, which comprises: a coil; a core designed to channel the flux of the coil so as to form a return path in the armature, the core having a base from which branches extend, including a central branch around which the coil extends; and two permanent magnets which, are associated with the core so that the latter channels the flux of the permanent magnets so as to form a return path in the armature, the flux of the coil passing through the magnets. According to the invention, the two permanent magnets are placed in the central branch of the core so as to form a V, which separates the central branch into a support part, which supports the permanent magnets and is integral with the base, and an end part lying above the permanent magnets, so that any section of the core or of the armature through which the flux of one or other of the permanent magnets can pass has an area large enough to avoid saturation of said section by this flux.

Thus, the core is separated into a main part, incorporating the part for supporting the magnets, the access to which, for positioning the permanent magnets, is completely free, and an end part, which is attached to the magnets placed on the support part so as to lie above them, the end part being centered by itself on the V formed by the permanent magnets and having no contact with the support part so that the risk of a short circuit between the support part and the end part is very low.

The sufficient area of the sections of the core or of the armature furthermore avoids any saturation by the flux of the permanent magnets, thereby helping to optimize the electromagnetic efficiency of the actuator.

BRIEF DESCRIPTION OF THE DRAWINGS

The invention will be more clearly understood in the light of the following description with reference to the figures of the appended drawings in which.

DETAILED DESCRIPTION OF THE INVENTION

Figure 1:
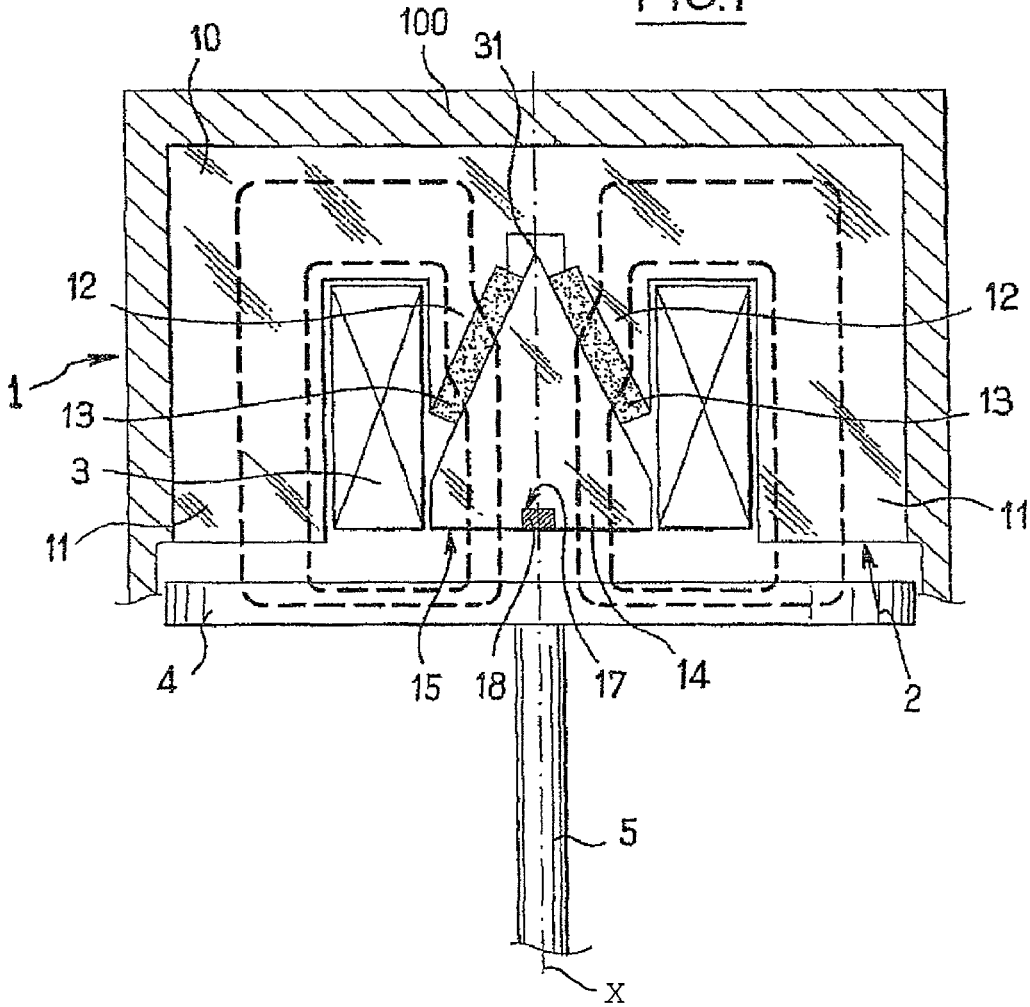
FIG. 1 is a partial schematic sectional view of an actuator according to the invention.

As shown in FIG. 1, the electromagnetic actuator of the invention comprises an electromagnet 1 with a core 2 and a coil 3. The electromagnet 1 exerts an electromagnetic force in a controlled manner on an armature 4 integral with a pushrod 5 that can move along the X axis.

Such an actuator is, for example, used to actuate an internal combustion engine valve, the actuator being placed in such a way that the pushrod 5 extends along the sliding axis of the valve. As is known, the actuator includes another electromagnet (not shown) that extends opposite the electromagnet 1 so as to selectively attract the armature 4 in the opposite direction. The end of the pushrod 5 and the end of the valve are returned to each other by opposing springs (not shown) that define an equilibrium position of the pushrod/valve assembly in which the armature extends substantially at mid-path between the two electromagnets.

The core 2 of the electromagnet 1 has a base 10 from which two lateral branches 11 and a central branch extend, the coil 3 extending around said central branch. The central branch comprises two portions 12 with facing inclined faces integral with the base 10. The portions 12 form a support part, for supporting the core 2, said part being designed to accommodate permanent magnets 13 so that the latter extend obliquely to the X axis and form a V, the point 31 of which here is turned toward the base 10. A wedge 14 forming an end part of the central branch is thus formed in the V.

The path of the flux lines generated by the permanent magnets 13, which pass through the core 2 so as to form a return path in the armature 4, is depicted as the bold dashed lines in FIG. 1. The wedge 14 has an end face 15 in which a groove 17 lies parallel to the permanent magnets 13. The groove 17 ensures that there is a sharp separation between the respective flux lines of the two permanent magnets 13 that pass on either side of the groove 17.

Figure 2:
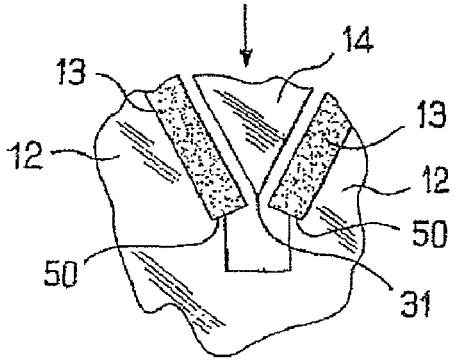
FIG. 2 is a partial schematic view of the actuator of FIG. 1, illustrated in the course of being mounted.

As may be seen in FIG. 2 (in which the core is illustrated upside-down with respect to FIG. 1), the actuator is mounted as follows. After having formed the core 2 by assembling the laminations that form the base 10, the lateral branches 11 and the support portions 12, the permanent magnets 13 are put into position on the support portions 12. In this regard, the support portions 12 include steps 50 making it easier to position the magnets 13. After having formed the wedge 14, by assembling the corresponding laminations, the wedge 14 is then attached to the permanent magnets 13 as indicated by the arrow. The wedge 14 then lies above the permanent magnets 13 and is self-centered by the V formed by the permanent magnets 13.

To keep the whole assembly in place, nonmagnetic clamps 18 are used, each of these having, on the one hand, an elongate part (visible in cross section in FIG. 1) that is housed in the groove 17 of the active face 15 of the wedge 14, and on the other hand, braces that extend into holes passing through the wedge 14, then between the permanent magnets 13 and finally in holes in the core 2 (these not being visible) so as to be fastened to the latter, for example by screwing or by riveting (as a variant, the braces could pass through the core 2 so as to be fixed directly to the body 100).

The clamps make it possible to exert a compressive force so as to take up, or even eliminate, the residual gap that may remain owing to the manufacturing tolerances between, on the one hand, the support portions 12 and the permanent magnets 13 and on the other hand, the permanent magnets 13 and the wedge 14. This gap take-up allows the magnetic efficiency of the actuator to increase.

Figure 3:
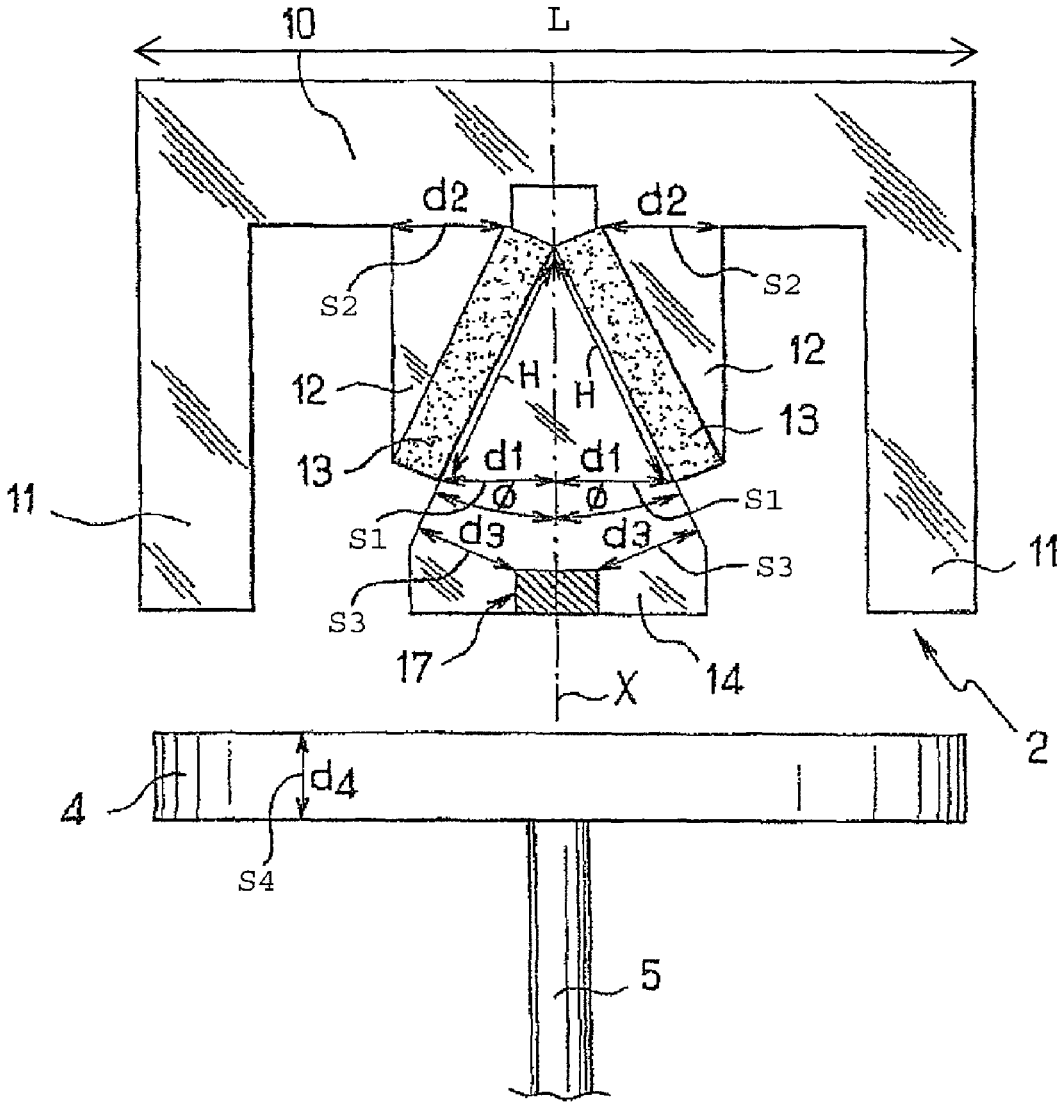
FIG. 3 is a partial schematic sectional view of an actuator according to the invention.

As may be seen in FIG. 3, the geometry of the core 2 imposes on the central branch of the latter critical passage sections for the flux lines of the permanent magnets 13. First critical sections S1 extend in the wedge 14 between one of the ends of the permanent magnets 13 and the central axis X. Second critical sections S2 each extend in one of the bearing portions between one of the ends of the corresponding permanent magnets 13 and the angle formed by the base 10 and the bearing portion 12. Finally, third critical sections S3 extend in the wedge 14 between an external face and the groove 17.

Each of these critical sections S1, S2, S3 has a minimum area through which the entire flux of one of the permanent magnets 13 passes.

Moreover, the armature 4 also has fourth critical sections S4 through which the entire flux of one or other of the permanent magnets 13 passes.

It is known that the constituent ferromagnetic material of the core 2 and of the armature 4 has a saturation threshold above which it becomes increasingly difficult to make additional flux pass through a given passage section. It is important, when in only the flux generated by the permanent magnets 13, for the constituent material of the core 2 and of the armature to work, in the critical sections S1, S2, S3, S4, below the saturation threshold so as to retain the possibility of the flux generated by the coil passing through them and thus providing said coil with an acceptable efficiency. To do this, the critical sections S1, S2, S3, S4 should have sufficiently large areas.

The width of the core 2 in the sections S1, S2, S3, is called d1, d2, d3 respectively. If L is the length of the core (measured along a direction perpendicular to the plane of the figure), the critical sections S1, S2, S3 have respective areas:

$$A1=L\times d1;\ A2=L\times d2;\ \text{and}\ A3=L\times d3.$$

Likewise if d4 is the width of the armature in the section S4 and if the length of the armature is taken to be approximately L, the area of the section S4 is A4=L×d4.

As regards the flux of the permanent magnets 13 this is approximately proportional to the area of the surface of the permanent magnets in contact with the core. If H is the height of the permanent magnets, this area is $$A=L\times H.$$

To avoid the critical sections being saturated, it is necessary to given an upper limit to the ratio of the flux to the area of the critical section in question, and therefore to limit the ratios:

$$r1=A/A1;\ r2=A/A2;\ r3=A/A3;\ \text{and}\ r4=A/A4.$$

The upper limit of these ratios depends on the nature of the constituent material of the core 2 and of the armature 4. The upper limit of the ratios r1, r2, r3, r4 is preferably equal to:

3.2 for a core or armature made of silicon-iron;

3.75 for a core or armature made of 17/18% cobalt-iron; and 4.15 for a core or armature made of 48/50% cobalt-iron.

Since the length L comes into the expressions for the areas A, A1, A2, A3 and A4 it should be noted that these ratios may also be expressed as r1=H/d1, r2=H/d2, r3=H/d3 and r4=H/d4 so that the ratios represent length ratios.

As may be seen in FIG. 3, the core 2 illustrated here is such that the wedge 14 terminates in a point approximately at those ends of the permanent magnets 13 which are opposite the ends where the sections S1 are taken in the wedge 14. Likewise, the bearing portions 12 terminate in a point at those ends of the permanent magnets 13 which are opposite the ends where the sections S2 are taken in the bearing portions 12. In this configuration, the tangent of the half-angle ϕ of the V formed by the permanent magnets 13 is approximately equal to d2/H or d1/H, i.e. the inverse of the ratios r1 and r2.

This therefore amounts to giving the ratios r1 and r2 an upper limit or to giving the half-angle ϕ at the apex of the V a lower limit. The lower limit of the half-angle ϕ of the apex of the V is preferably equal to:

17° for a core made of silicon-iron;

13.5° for a core made of 17/18% cobalt-iron; and

12° for a core made of 48/50% cobalt-iron.

These values make it possible to prevent saturation in the critical sections under just the flux of the permanent magnets 13. In any event, the half-angle ϕ at the apex of the V will be chosen to be equal to or greater than 10°.

However, the ratios r1, r2, r3, r4 should not be too small as otherwise this would lead to excessively large passage sections limiting the efficiency of the permanent magnets 13. In practice, the ratios r1, r2, r3, r4 are preferably chosen to be equal to or greater than 2. In terms of angle, this condition amounts to limiting the half-angle ϕ of the V to a value equal to or less than 25°.

The invention is not limited to what has just been described, rather quite to the contrary it encompasses any variant falling within the scope defined by the claims.

In particular, although actuators have been illustrated here in which the permanent magnets form a V, the tip 31 of which is turned toward the base of the core, it will also be possible to place the magnets in such a way that they form a V with the tip 31 directed toward the armature. The magnet support part of the base will have inclined faces no longer facing each other but being turned toward the lateral branches, whereas the end part of the central branch will no longer have a wedge shape but a hat shape.

Although critical sections have been considered here in the central branch, it is obvious that the limits that apply to the ratios r1, r2, r3, r4 also apply to any similar ratio associated with any section taken in the rest of the core or of the armature, said ratio then being equal to the area of the surface of the permanent magnet to the area of the relevant section.

The invention claimed is:

1. An electromagnetic actuator, having an actuating member associated with an armature and capable of moving under an action of at least one electromagnet, comprising:

a coil;

a core designed to channel a flux of the coil so as to form a return path in the armature, the core having a base from which branches extend, including a central branch around which the coil extends; and two permanent magnets which are associated with the core so that the core channels the flux of the permanent magnets so as to form a return path in the armature, the flux of the coil passing through the magnets, wherein the two permanent magnets are placed in the central branch of the core so as to form a V, which separates the central branch into a support part, which supports the permanent magnets and is integral with the base, and an end part lying above the permanent magnets, and wherein critical sections of the core or of the armature through which the flux of one or another of the permanent magnets passes, comprise:

first critical sections extending in the end part between one end of the permanent magnets and a central axis X; and second critical sections, each second critical section extending in one of the support part between another end of the corresponding permanent magnets and an angle formed by the base and the support part, wherein an upper limit is given to ratios between an area of a surface of the permanent magnet, such surface being in contact with the core, and an area of said first and second critical sections, said upper limit of the ratios depending on a material used for the core and for the armature.

2. The electromagnetic actuator as claimed in claim 1, wherein each of said critical sections of the core is shaped so as to have the ratio between the area of said surface of the permanent magnet, the flux of which passes through said critical section, and the area of said critical sections which is less than or equal to:

3.2 for a core or armature made of silicon-iron;

3.75 for a core or armature made of 17/18% cobalt-iron; and 4.15 for a core or armature made of 48/50% cobalt-iron.

3. The electromagnetic actuator as claimed in claim 2, wherein, for each of said critical sections, the ratio is greater than or equal to 2.

4. The electromagnetic actuator as claimed in claim 1, wherein at least one of the parts of the core terminates in a point at one end of one of the permanent magnets, the V formed by the permanent magnets having an apex half-angle sufficient to avoid, in said part, saturation of a section taken at an opposite end of said permanent magnet.

5. The electromagnetic actuator as claimed in claim 2, wherein an apex half-angle of the V formed by the permanent magnets is greater than or equal to 10°.

6. The electromagnetic actuator as claimed in claim 5, wherein the apex half-angle of the V is greater than or equal to:

17° for a core made of silicon-iron;

13.5° for a core made of 17/18% cobalt-iron; and

12° for a core made of 48/50% cobalt-iron.

7. The electromagnetic actuator as claimed in claim 4, wherein the apex half-angle of the V formed by the permanent magnets is less than or equal to 25°.

8. The electromagnetic actuator as claimed in claim 1, wherein the V formed by the magnets has a downwardly facing point, the end part having a wedge shape.

9. The electromagnetic actuator as claimed in claim 1, further comprising a groove lying parallel to the permanent magnets in an end face of the end part, and wherein third critical sections extend in the end part between an external face and the groove.

10. The electromagnetic actuator as claimed in claim 1, wherein the armature also has fourth critical sections through which the flux of one or other of the permanent magnets passes.

* * * * *